US005147452A

United States Patent [19]

Anderson et al.

[11] Patent Number: 5,147,452

[45] Date of Patent: Sep. 15, 1992

[54] METHOD OF AGGLOMERATING MINERAL ORE CONCENTRATE

[75] Inventors: Dale J. Anderson, Tinley Park, Ill.; David C. Cloutier, Dyer, Ind.

[73] Assignee: Betz Laboratories, Inc., Trevose, Pa.

[21] Appl. No.: 690,434

[22] Filed: Apr. 24, 1991

[51] Int. Cl.[5] ..... C22B 1/16

[52] U.S. Cl. ..... 75/767; 75/321

[58] Field of Search ..... 75/772, 767, 321

[56] References Cited

U.S. PATENT DOCUMENTS

| | | | |
|---|---|---|---|
| 2,854,347 | 9/1958 | Booth et al. | 117/6 |
| 3,660,073 | 5/1972 | Youngs et al. | 75/3 |
| 3,860,414 | 1/1974 | Lang et al. | 75/3 |
| 3,893,847 | 7/1975 | Derrick | 75/3 |
| 4,362,559 | 12/1982 | Perez et al. | 75/3 |
| 4,551,261 | 11/1985 | Salihar | 252/88 |
| 4,561,905 | 12/1985 | Kittle | 134/25.1 |
| 4,571,116 | 2/1986 | Patil et al. | 404/76 |
| 4,780,233 | 10/1988 | Roe | 252/88 |
| 4,802,914 | 2/1989 | Rosen et al. | 75/767 |

FOREIGN PATENT DOCUMENTS

| | | | |
|---|---|---|---|
| 1403187 | 8/1975 | United Kingdom | 75/959 |

OTHER PUBLICATIONS

U.S. Dept. of the Interior, Bureau of Mines Report, "Effectiveness of Organic Binders for Ore Pelletization", 1989, Haas et al.

*Primary Examiner*—Melvyn J. Andrews

*Attorney, Agent, or Firm*—Alexander D. Ricci; Steven D. Boyd

[57] ABSTRACT

Minor amounts of water insoluble elastomeric polymers are combined with oil which is applied in an aqueous spray as an agglomeration aid.

5 Claims, No Drawings

METHOD OF AGGLOMERATING MINERAL ORE CONCENTRATE

FIELD OF THE INVENTION

This invention relates generally to methods for agglomerating or pelletizing ore concentrate. More particularly, this invention relates to methods for agglomerating or pelletizing mineral ore concentrate using an aqueous solution comprising an oil-in-water emulsion wherein the oil phase includes a water insoluble elastomeric polymer. Surfactants may be used to emulsify the oil/water mixture.

BACKGROUND OF THE INVENTION

It is customary in the mining industry to agglomerate or pelletize finely ground mineral ore concentrate so as to facilitate the handling and shipping of the ore. Similarly, in the benefication of iron ore for use as feed to an iron making process, unit operations such as crushing, concentration, separation and agglomeration or pelletization are employed. The agglomeration of concentrated ore may include the production of ore pellets, sinter, nodules and briquettes. The agglomerated or pelletized ore for iron making must provide acceptable gas permeability (gas-solid contact) in a blast furnace. Sintering and pelletization are the most widely used forms of ore agglomeration in the iron making industry.

In the process of agglomeration or pelletization, grinding and screening is followed by the production of ore balls using equipment such as a balling drum or a disc pelletizer. Ore balls formed in the balling drum or disc pelletizer must be stable, that is resistant to attrition in the subsequent handling processes. Filler and/or binding agents are often added to the feed to aid balling and hold the mineral ore concentrate together as pellets until after firing. Typical additives include fillers such as lime, burnt lime, bentonite clay, olivire or water soluble polymers. In addition to such binding aids, adjustment of the moisture content of the ore concentrate also takes place typically by adding moisture via water sprays.

After balling operations, the pellets are formed, but they are still wet. These pellets are commonly known as "green pellets". The green pellets are transported to a kiln and indurated by heating in stages to an end temperature of approximately 2800° F. After heating, the fired pellets are extremely hard and resist cracking upon being dropped and resist crushing when compressed.

The permeability of the treated pellets is important. Thermal shock resistance is a factor which is related to the permeability of the treated pellets. Increases in permeability increased the thermal shock resistance by improving the pellets ability to resist internal pressures created by the sudden evaporation of water when the pellet is heated. If the pellets are not sufficiently permeable, the pellets have an increased tendency to shatter upon rapid heating. This causes a concurrent increase in the amount of fines or coarse particles in the agglomerated ore. In addition, the indurated mineral ore must exhibit sufficient gas permeability to provide the required gas-solid contact in an iron making blast furnace.

The addition of materials to an ore concentrate prior to agglomeration is known. Moisture in the form of water sprays is often added to ore concentrate to facilitate agglomeration. Binding agents such as bentonite, burnt lime as well as organic binders such as poly(acrylamide), polymethylacrylamide, carboxymethylcellulose, hydroxyethylcellulose, carboxyhydroxyethylcellulose, poly(ethylene oxide), guar gum and others may be added to ore concentrate. In some operations, organic binders are favored over bentonite because the organic binders do not increase the silica content of the pellets. Organic binders will burn out during pellet firing operations and cause an increase in the porosity of the pellets.

U.S. Pat. No. 3,893,847, Derrick, discloses a binder and method for agglomerating mineral ore concentrate. The binder used is a high molecular weight, substantially straight chain water soluble polymer. The polymer is used in an aqueous solution. The polymers disclosed as useful in Derrick include copolymers of acrylamide as well as other polymers. The polymers of Derrick are employed in an aqueous solution.

U.S. Pat. No. 4,802,914 to Rosen et al., discloses a process of agglomerating a mineral ore concentrate in which a water soluble, high molecular weight polymer binder is employed. The polymer is applied as a water-in-oil emulsion, or a dispersion of fine polymer particles in oil or as a dry powder. The disclosed polymers include water soluble homopolymers, copolymers, terpolymers, and tetrapolymers. Suitable polymers include synthetic vinyl polymers and other polymers as distinquished from derivatives of natural cellulosic products.

SUMMARY OF THE INVENTION

The present invention provides a method for agglomerating a particulate material such as mineral ore concentrate with an aqueous solution including oil and minor amounts of a water insoluble elastomeric polymer. The inclusion of minor amounts of a water insoluble elastomeric polymer in the oil phase of an oil-in-water emulsion was found to provide improved ball agglomeration of particulate materials such as iron ore. The agglomeration aid of the present invention is conveniently added to the moisture (water sprays) addition phase of a typical balling drum or pelletizer.

DETAILED DESCRIPTION OF THE PREFERRED EMBODIMENT

This invention is a method for agglomerating particulate materials such as mineral ore concentrate using an oil based treatment that includes a small amount of a water insoluble elastomeric polymer. The oil based treatment is added to the water sprays of a balling drum or pelletizer to form an oil-in-water emulsion or dispersion. Surfactants may also be added to the water spray to assist in the formation of a stable emulsion and also to improve contact of the spray with the ore concentrate.

The water insoluble elastomers that may be employed are those as described in U.S. Pat. No. 4,551,261, Salihar and U.S. Pat. No. 2,854,347, Booth et al. These generally may be described as being synthetic rubber like polymers which encompass copolymers of butadiene with a monoolefinic monomer such as styrene, methylstyrene, dimethylstyrene and acrylonitrile. Copolymers of methyl, ethyl and butyl acrylates with acrylonitrile or with styrene may also be mentioned. Plasticized polyvinyl acetate, plasticized polyvinyl chloride, plasticized polystyrene, plasticized substituted polystyrene, and plasticized polyolefins such as polyethylene and polyisobutylene are suitable. At present, it is preferred to utilize a polyisobutylene elastomer having a molecular weight within the range of about 500,000 to about 2 million, with a particular polyisobutylene of around 1 million molecular weight being particularly preferred. It is essential that the elastomer be water insoluble so that it is carried by the oil phase of the aqueous spray. In this manner, it is thought that the elastomer serves to increase the tackiness of the oil, thereby extending or enhancing the agglomerating activity while not adversely effecting the properties of the formed pellets. As used broadly herein, the term oil includes mineral (petroleum or petroleum derived), vegetable and animal oils.

Any oil capable of being spray applied in an aqueous medium may be used. Especially preferred are oils that are capable of being emulsified in an oil-in-water or water-in-oil emulsion or dispersion. For example, asphalts, extender oils of the type noted in U.S. Pat. No. 4,571,116, heavy process oils, and light process oils may be mentioned. The heavy process oils and light process oils are of the type specified by Kittle, U.S. Pat. No. 4,561,905. That is, they include asphalt "cut-backs", i.e., asphalt dissolved in a moderately heavy oil such as No. 3 fuel oil, residual fuel oils of relatively high viscosity such as No. 6 fuel oils, etc. The heavy process oils may be further defined as having viscosities in the range of about 600 to 7,000 SUS. One exemplary heavy process oil is "Hydrolene 90" sold by Sun Oil Company. This particular product is a low volatile aromatic oil having an SUS viscosity of about 3500 at 38° C.

Preferred oils are classified as "light viscosity process oils". These have SUS viscosities of about 60-600 measured at 38° C. Highly preferred are those having an SUS viscosity of from about 200 to 400. The latter are commercially available under the "Shellflex", "Tellura" and "Tufflo" trademarks.

Surfactants may be used to emulsify the oil/water mixture. For this purpose, well known and commercially available anionic and/or nonionic surfactants suffice. For instance, acceptable anionic surfactants include alkyl aryl sulfonic acids, alkyl sulfonic acids, alkenyl sulfonic acids, sulfonated alkyls, sulfonated alkenyls, sulfated monoglycerides and sulfated fatty esters. Also, long chain alpha olefin sulfonates, water soluble salts of alkenyl sulfonic acid, water soluble alkyl aryl sulfonic acid salts, water soluble salts of sodium lauryl sulfate, etc. may be mentioned.

Nonionic surfactants which may be used include ethylene oxide condensates of alkylphenols, ethylene oxide condensate of straight chain alcohols, fatty acid amides, etc.

The oil/water insoluble elastomer combination may be provided in one drum to be mixed with the aqueous spray of a balling drum or pelletizer. Exemplary compositions are:

1 to 25 weight percent anionic and/or nonionic surfactants, 0.01 to 0.3 weight percent water insoluble elastomeric polymer (note that commercially available products comprise water insoluble elastomeric polymers in solution with an oil solvent), and the remainder oil.

The oil solution is mixed with the feedwater of an aqueous spray in a balling drum or pelletizer. Generally, enough water and oil solution is mixed and sprayed so that from about 0.8 to about 1.0 percent of the oil/elastomer mixture is applied per ton of treated ore concentrate. The specific amount of oil/elastomer treatment solution to be applied depends, of course, upon the ore type and mesh size as well as the specifics of the balling drum or pelletizer design.

At present, a preferred oil/elastomer treatment solution is: 5.0 weight percent isopropylamine dodecylbenzene sulfonate, 4 weight percent oleic acid, 0.06 weight percent polyisobutylene (molecular weight 1 million), remainder light process oil (275 SUS at 100° F.).

The invention will now be further described with reference to the following specific example which is to be regarded solely as illustrative and not as restricting the scope of the invention.

An evaluation was undertaken in an operating sinter plant in a steel mill in which the preferred oil/elastomer treatment solution described above was employed. The method of the present invention replaced burnt lime which was being used as a sinter aid. The oil/elastomer treatment solution of the present invention was injected into the sinter mix cooling water. The effect was evaluated by monitoring the bed permeability. The feed rate of the oil/elastomer solution was varied from 0.9 to 1.0 gallons per ton of material being treated. The initial low feedrates were chosen to insure that the method would have no detrimental effects on the production of the sinter unit. The higher feedrates, 30 to 40 gallons per minute, were run to determine bed permeability at such treatment rates. At these feedrates, it was also found that the roll feeder operated without sticking and the visual opacity reading of the stack discharge decreased from 25 to 19 while the bed permeability showed a 46% increase. Table 1 summarizes the results of these evaluations.

TABLE 1

| Time | Feedrate | Average Permeability (1 hour average) |
|---|---|---|
| 7 am | 0 | 0.6876 |
| 8 am | 21.9 | 0.6804 |
| 9 am | 30.1 | 0.8498 |
| 10 am | 40.9 | 0.6918 |
| 11 am | 40.9 | 0.5332 |
| Noon | 40.9 | 0.4515 |
| 1 pm | 40.9 | 0.4449 |
| 2 pm | 40.9 | 0.4383 |
| 3 pm | 40.9 | 0.3731 |

While the invention has been described with respect to particular embodiments thereof, it is apparent that numerous other forms and modifications of this invention will be obvious to those skilled in the art. The appended claims in this invention should be construed to cover all such obvious forms and modifications which are within the true spirit and scope of the present invention.

What is claimed is:

1. A method of agglomerating a particulate material prior to sintering comprising comingling said particulate with a binding amount of a treatment solution consisting essentially of oil and from a trace up to about 0.06 weight percent, based upon the weight of said oil, of a water insoluble elastomeric polymer in an aqueous spray to form an agglomerate and thereafter heating said agglomerate to a sintering temperature.

2. The method of claim 1 wherein said treatment solution is applied to said particulate material in an aqueous solution.

3. The method of claim 2 wherein said treatment solution further includes an anionic and/or nonionic surfactant.

4. The method of claim 3 wherein said treatment solution comprises about 1 to 25 weight percent anionic and/or nonionic surfactant, about 0.01 to 0.06 weight percent water soluble elastomeric polymer, the remainder oil.

5. The method of claim 3 wherein said treatment solution comprises about 5.0 weight percent isopropylamine dodecyl benzene sulfinate, about 4.08 percent oleic acid, about 0.06 weight percent polyisobutylene, the remainder oil.

* * * * *